US008146418B2

(12) United States Patent
Foo et al.

(10) Patent No.: US 8,146,418 B2
(45) Date of Patent: Apr. 3, 2012

(54) APPARATUS AND METHOD FOR SOIL TESTING FOR JACK-UP RIGS

(75) Inventors: Kok Seng Foo, Singapore (SG); Chin Kau Quah, Singapore (SG); Okky Ahmad Purwana, Singapore (SG); Lodewijk Keizer, Heerenveen (NL); Mark Felton Randolph, Perth (AU); Mark Jason Cassidy, Shenton Park (AU)

(73) Assignees: Keppel Offshore & Marie Technology Centre Pte Ltd, Singapore (SG); A.P. van den Berg Holding bv, Heerenveen (NL)

( * ) Notice: Subject to any disclaimer, the term of this patent is extended or adjusted under 35 U.S.C. 154(b) by 806 days.

(21) Appl. No.: 12/202,884

(22) Filed: Sep. 2, 2008

(65) Prior Publication Data

US 2010/0050764 A1 Mar. 4, 2010

(51) Int. Cl.
*E02D 1/04* (2006.01)

(52) U.S. Cl. ..... 73/170.32

(58) Field of Classification Search ..... 73/78, 81–85, 73/170.32

See application file for complete search history.

(56) References Cited

U.S. PATENT DOCUMENTS

| | | | | | |
|---|---|---|---|---|---|
| 3,611,794 | A | * | 10/1971 | Geeter | 73/85 |
| 3,690,166 | A | * | 9/1972 | Grice et al. | 73/84 |
| 3,700,049 | A | | 10/1972 | Tiraspolsky et al. | |
| 3,940,982 | A | * | 3/1976 | Hironaka | 73/170.32 |
| 3,958,646 | A | | 5/1976 | Pellissier | |
| 4,043,407 | A | * | 8/1977 | Wilkins | 175/50 |
| 4,530,236 | A | | 7/1985 | van den Berg | |
| 4,601,354 | A | * | 7/1986 | Campbell et al. | 175/46 |
| 4,735,526 | A | | 4/1988 | Kawagoe et al. | |
| 5,127,261 | A | * | 7/1992 | Ingram et al. | 73/84 |
| 5,165,274 | A | | 11/1992 | Thiercelin | |
| 5,339,679 | A | | 8/1994 | Ingram et al. | |
| 5,587,540 | A | | 12/1996 | Meyer | |
| 6,062,090 | A | | 5/2000 | Bachhuber et al. | |
| 6,299,385 | B1 | | 10/2001 | Barnes | |
| 6,390,206 | B1 | | 5/2002 | Aardal | |
| 6,463,801 | B1 | | 10/2002 | Young et al. | |
| 6,920,780 | B2 | * | 7/2005 | Hubbell et al. | 73/73 |
| 7,234,362 | B2 | * | 6/2007 | Shinn et al. | 73/784 |
| 7,377,319 | B2 | * | 5/2008 | Patterson | 166/250.17 |
| 7,493,803 | B2 | | 2/2009 | Kelleher et al. | |
| 7,810,381 | B2 | * | 10/2010 | Boggess | 73/84 |
| 2006/0051164 | A1 | * | 3/2006 | Foo et al. | 405/228 |

OTHER PUBLICATIONS

Watanabe, Y., "Development and Field Tests on Prototype of Leg Penetration Monitor System to Avoid the Punch-Through Accidents of Jackup Rigs", 22nd Annual OTC in Houston, Texas, May 7-10, 1990.

Tateishi et al., "Leg Penetration Monitor System to Avoid the Punch-Through Accidents of Jackup Rigs," 18th Annual Offshore Technology Conference in Houston, Texas,1986, pp. 19-30.

* cited by examiner

*Primary Examiner* — Freddie Kirkland, III

(74) *Attorney, Agent, or Firm* — Venable LLP; Michael A. Sartori; Ryan M. Flandro

(57) ABSTRACT

An apparatus for soil testing for a jack-up rig, the apparatus comprising a soil testing device integrated with a leg of the jack-up rig, the leg of the jack-up rig having a footing, an opening in the footing for allowing passage of an active portion of the soil testing device therethrough to obtain soil data from a seabed beneath the footing, and a retrieval assembly for retrieving the soil testing device.

18 Claims, 8 Drawing Sheets

APPARATUS AND METHOD FOR SOIL TESTING FOR JACK-UP RIGS

TECHNICAL FIELD

This invention relates generally to soil testing and relates more particularly, though not exclusively, to an apparatus and method for soil testing for jack-up rigs.

BACKGROUND

A jack-up rig is an offshore oil exploration drilling structure for use in shallow water, typically in water depths up to 500 feet. The jack-up rig normally comprises a floatable hull with a deck or working platform and three or four legs. After arriving on location, the legs of the jack-up rig are lowered until they touch a seabed beneath the hull. This allows the hull to be supported by the legs that rest on a foundation soil on the seabed so that the hull may be jacked up using a jacking system to raise the working platform above the water, making the jack-up rig safer to be operated in open water situations where water movement is experienced.

The legs of a jack-up rig are commonly trusses, each truss comprising vertical chords connected with cross braces that are normally diagonally disposed. The legs normally terminate in a footing that rests on the seabed. The footing provides an enlarged soil bearing area so as to reduce pressure exerted on the soil of the seabed. This in turn reduces bearing capacity that is required by the soil to support the jack-up rig, allowing the jack-up rig to be operated in a greater variety of locations and soil types.

Spud can footings are individual footings each connected to one leg of the jack-up rig. This allows the jack-up rig to be used on uneven seabeds and on slopes as the length of each leg may be independently adjusted relative to the other legs. A spud can is typically shaped like a top, having a generally conical upper half connected to the leg and a generally conical lower half for contact with the seabed. The conical bottom half helps ensure some penetration into the seabed, even in very stiff soils, so as to provide some anchoring of the legs into the seabed.

To reliably support the hull above water, the legs of the jack-up rig must be installed on the seabed in a way that can withstand maximum expected loads, such as those experienced in extreme storm conditions or during drilling operations. To assure sufficient bearing capacity of the seabed, an operation known as preloading must be performed for jack-up rigs by ballasting the hull with sea water. In the preloading operation, soil at the seabed supporting the legs is artificially loaded to a full load that can be expected when the jack-up rig is in its extreme or most severe condition, normally at "storm survival mode". This is to reduce the likelihood of soil failure during the extreme condition, leading to catastrophic consequences for the jack-up rig.

During preloading, the legs of the jack-up rig are allowed to penetrate the seabed under the weight of the jack-up with its hull ballasted, with the spud cans failing the soil of the seabed until a point where the seabed resistance finally equals the load imposed by the spud cans. When there is no further settling of the legs into the soil for a predetermined holding period, preloading is complete and the hull can be safely jacked up to full operational air gap above the water.

During preloading, there is a risk of soil failure of the seabed under the spud can footings. Some modes of soil failure include punch-through and rapid leg penetration. Punch-through is an extreme event and may occur in a seabed composed of strong overlying weak layers, for example, a sand layer overlying soft clay. When applied load during preloading exceeds the bearing capacity of the sand layer, the sand layer will suddenly give way and the spud can will punch-through the sand layer to plunge into the underlying soft clay. The leg experiencing this failure will continue to penetrate the seabed until either the soil is once again able to support the leg, or the hull enters the water to a point where buoyancy of the hull provides enough support of the entire rig to halt further leg penetration into the soil. Rapid leg penetration may occur if preloading of a leg takes place on unexpectedly soft or weak soil and the leg moves downward during preloading faster than the jacking system is able to actively jack up the hull.

When punch-through or rapid penetration occurs, the hull becomes out of level, causing all the legs to experience increased transverse loads. Some of the load previously carried by the leg experiencing the soil failure is also transferred to the other legs. Accidental loading resulting from a punch-through or rapid leg penetration can lead to several types of leg damage including buckling of the braces, buckling and/or shearing of the chords, joint damage and even damage to the jacking system. Such damage is extremely costly and rig operators have to be insured to cover the risks.

To minimize the occurrence of punch-through or rapid leg penetration, proper testing of the foundation soil where a jack-up rig is to be sited is extremely important, so as to avoid attempting to install a jack-up rig on soil that is unable to appropriately support the rig with an adequate safety margin.

Soil testing for jack-up rigs is normally carried out by conducting one or more geotechnical surveys prior to towing the jack-up rig to a drilling location. Such a survey typically includes borehole tests with various shear strength tests conducted on site and/or in a laboratory, as well as piezo-cone penetration tests (PCPT) at various points about the intended rig location. Results from the geotechnical surveys allow spud can penetration predictions to be made, as well as other geotechnical aspects to be evaluated.

Although geotechnical surveys may be conducted for a site, it is often found that information obtained in such surveys is deemed insufficient or inaccurate upon actual going on location and installing the jack-up rig. This may be due to an offset of boring locations during the geotechnical survey from the final installation site, with the problem being exacerbated in areas where there is considerable lateral variation of the seabed and where soil testing has only been undertaken at a limited number of points about the site. Another cause for discrepancy may be associated with re-orientation or adjustment of the rig location during actual installation, resulting in a deviation of the final location from the originally intended and surveyed site.

If geotechnical information is insufficient or there is doubt as to the reliability of existing information and associated spud can penetration prediction, further soil testing are necessary and may be carried out using a drilling cantilever extending from the rig itself. In such cases, the jack-up rig is first towed to location and allowed to come to rest on the seabed. Soil testing using the drilling cantilever is then carried out prior to conducting the preloading operation. However, there are inherent risks to the stability of the structure when extending the drilling cantilever for operations before the jack-up rig has been properly preloaded and installed on site. In addition, conducting such soil testing using the drilling cantilever will naturally delay installation of the jack-up rig for some time.

SUMMARY

The invention aims to provide a new and useful apparatus and method for soil testing. Using the invention, reliable soil data of the seabed that is intended to support the jack-up rig may be obtained with minimal delay to installing the jack-up rig.

In the absence of soil information for a particular site, the invention allows footing penetration prediction to be made in order to identify potential hazards associated with jack-up rig installation, such as potential punch-through or rapid leg penetration.

Where information obtained through standard site-specific geotechnical surveys is available, the invention provides supplementary information to improve jack-up footings penetration prediction, providing jack-up rig operators with a greater level of confidence to safely install the jack-up rigs.

In general terms, the invention proposes that a soil testing device is integrated with a leg of the jack-up rig such that an active portion of the soil testing device may pass through an opening in a footing of the leg to obtain soil data from a seabed directly beneath the footing.

The apparatus includes a retrieval assembly for raising the soil testing device out of the water after soil testing, so as to prolong the life of the soil testing device for subsequent use when exploring other locations with the jack-up rig. Retrieving the soil testing device after use also allows maintenance and trouble shooting of the soil testing device to be performed at any time during operation.

A specific expression of the invention is an apparatus for soil testing for a jack-up rig, the apparatus comprising a soil testing device integrated with a leg of the jack-up rig, the leg of the jack-up rig having a footing, an opening in the footing for allowing passage of an active portion of the soil testing device therethrough to obtain soil data from a seabed beneath the footing, and a retrieval assembly for retrieving the soil testing device.

BRIEF DESCRIPTION OF THE DRAWINGS

In order that the invention may be fully understood and readily put into practical effect there shall now be described by way of non-limitative example only exemplary embodiments, the description being with reference to the accompanying illustrative drawings.

In the drawings.

DETAILED DESCRIPTION OF EXEMPLARY EMBODIMENTS

Figure 1:
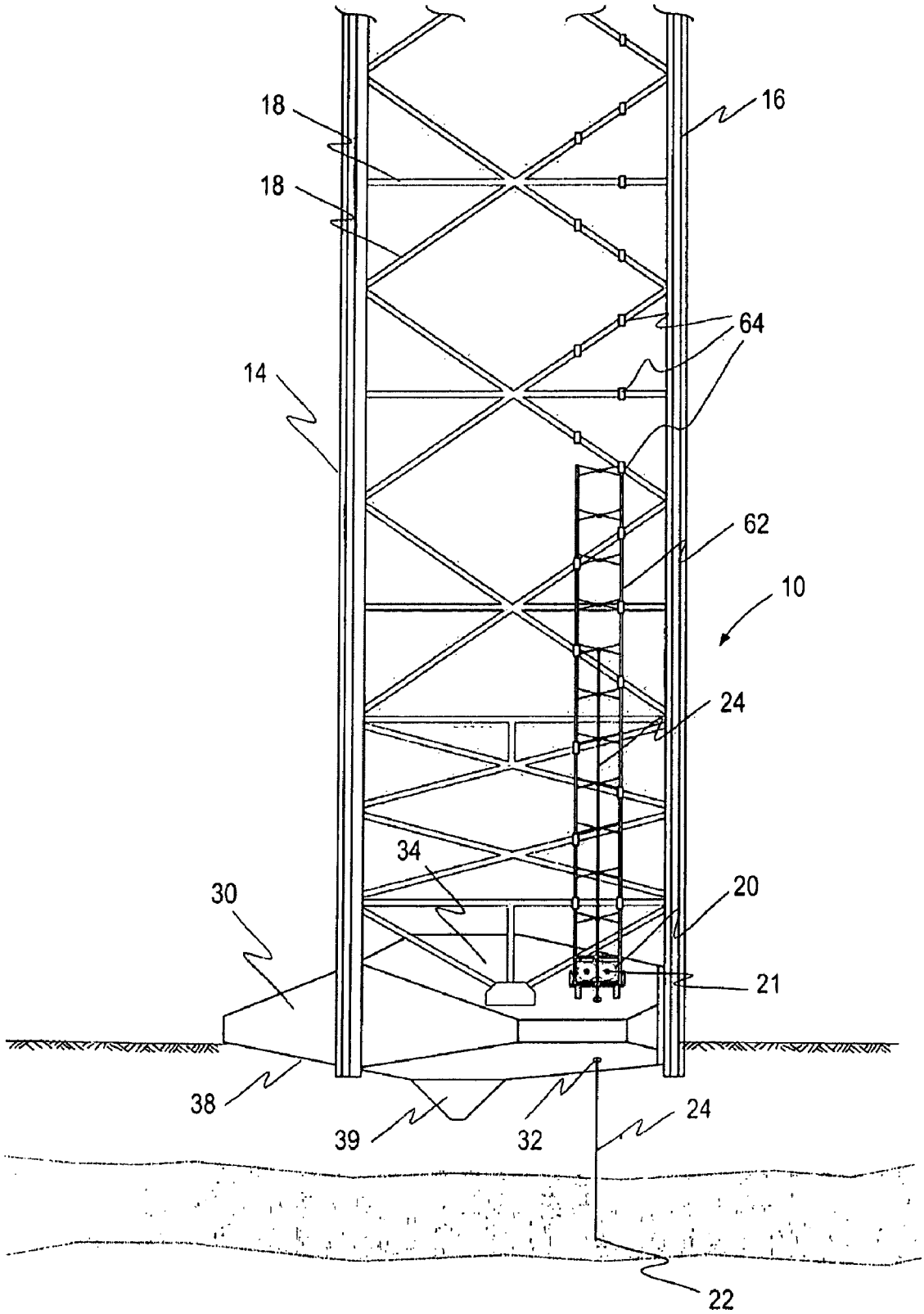
FIG. 1 is a schematic view of an exemplary embodiment of an apparatus for soil testing for a jack-up rig.

As shown in the figures, there is provided an apparatus 10 and a method 200 for soil testing for jack-up rigs.

The apparatus 10 comprises a soil testing device 20 integrated with a leg 14 of a jack-up rig (not shown). The soil testing device 20 may be integrated with the leg 14 during manufacture of the leg 14. Alternatively, the soil testing device 20 may be integrated with the leg 14 after production of the jack-up rig. The leg 14 is typically a three-dimensional truss having three or four vertical chords 16 connected with a plurality cross braces 18. The leg 14 terminates in a footing 30. Preferably, the footing 30 is a spud can. The soil testing device 20 is preferably mounted within the leg 14 in an elongate space defined by the vertical chords 16, or may be mounted to the leg 14 outside the elongate space defined by the vertical chords 16. The soil testing device 20 comprises an active portion 22 for obtaining soil data from the seabed directly beneath the footing 30.

The soil testing device 20 is preferably a penetrometer 20 comprising a drive unit 21 driving a push rod 24 connected to a penetrometer head 22. The drive unit 21 may comprise a thrust system of a hydraulic-push-and-puller type. Alternatively and preferably, the drive unit 21 comprises a double-wheeled thrust system, such as a ROSON thrust system disclosed in U.S. Pat. No. 4,530,236. The push rod 24 is clamped between two friction wheels that are biased towards each other using hydraulic cylinders. The wheels may be smooth or serrated. Rotation of both wheels at equal speeds in opposite directions either push down or retract the push rod 24, thereby pushing down or retracting the penetrometer head 22. A depth encoder may be provided to measure actual travel distance of the push rod 24. The drive unit 21 may be powered by a power supply located on the deck 11 of the jack-up rig via an umbilical cable 72 connection. Alternatively, the drive unit 21 may be integrated with a battery pack 27, reducing the amount of cabling required.

The penetrometer head 22 is preferably cone-shaped and equipped with sensors and gauges for measuring tip resistance $q_c$, shaft friction $f_s$, pore water pressure u, inclination $I_x$ $I_y$, penetration depth, drive unit depth, signal integrity and other parameters required for stratigraphic profiling and soil strength determination. Alternatively, the penetrometer head 22 may be ball-shaped, or T-bar shaped. Preferably, the penetrometer head 22 is of a self-calibrating type. The push rod 24 may comprise a plurality of rod segments with each segment measuring about 1 m long. Both ends of a rod segment may be of a screw type for quick attachment and release with another rod segment. The plurality of rod segments together form the push rod 24 or penetrometer string that preferably ranges in length from about 25 m to about 35 m. This is to allow the penetrometer head 22 to penetrate the seabed to depths of between about 20 m to about 30 m to sufficiently identify soil layering conditions which may potentially cause punch-through, rapid leg penetration or other jack-up rig installation hazards.

Due to the length of the push rod 24 or penetrometer string, a rod support 50 of similar length is required to support the push rod 24 when push rod 24 is out of the seabed. The rod support 50 preferably comprises a plurality of cross frames 52, each cross frame 52 having bilateral symmetry and having a centrally disposed funnel 54 through which the push rod 24 may be passed.

A reaction base 40 is preferably provided for resisting reaction forces of up to 100 kN generated when the active portion 22 is pushed into the seabed during testing. The reaction base 40 is preferably secured to the top 34 of the spud can 30, or may be secured to another part of the leg 14. The soil testing device 20 is preferably configured to be releasably lockable to the reaction base 40 via a latching mechanism 42 to allow the soil testing device 20 to be retrieved after soil testing has been conducted. The latching mechanism 42 may comprise a series of hydraulically-driven latches 23 at a bottom of the driver unit 21 and corresponding slots 43 at a bottom of upstanding tapered flanges 44 in the reaction base 40. The latches 23 may be activated to lock into or unlock from the slots 43 by a hydraulics unit contained in the driver unit 21. Alternatively, the hydraulics unit may be located on the hull 11 and operatively connected to the latches 23 via an umbilical cable 72.

In order for the soil testing device 20 to be able to obtain soil data from the foundation soil that will be directly supporting the jack-up rig, the active portion 22 is preferably located within the footprint of the spud can 30 so as to enable data to be obtained from the soil immediately therebelow. To do so, the spud can 30 is provided with an opening 32 through which the active portion 22 may pass. Where the soil testing device is a penetrometer 20, the opening 32 is preferably a through hole having a guide tube 36 therein for passage of the push rod 24 and the penetrometer head 22. The guide tube 36 preferably comprises dirt removing studs 33 for cleaning the push rod 24 when it is being retracted. Alternatively, the opening 32 may comprise a through slot in the spud can 30. In this way, the active portion 22 may pass through the spud can 30 to penetrate the seabed directly beneath the spud can 30 and obtain soil information from the seabed that is to support the jack-up rig.

To use the apparatus 10, the jack-up rig is towed to site and upon reaching its intended location, its legs 14 are lowered until the spud can 30 of each leg 14 contacts the seabed 202. Preferably, each spud can 30 penetrates the seabed only just up to achieving full bearing contact of the bottom surface 38 of the spud can 30, so as to provide a stable base with minimal disturbance to the seabed soil. If there is a hard crust on the surface of the seabed, at least the tip 39 of the spud can 30 should be fully embedded in the seabed. The hull of the jack-up rig under the water is preferably secured to anchor tug vessels to prevent the leg 14 from imposing too much stress onto the seabed and to minimize sway motion of the leg 14.

For the leg 14 integrated with the soil testing device 20, the soil testing device 20 is preferably already set up in operational position on the spud can 30 so that the soil testing device 20 may be lowered at the same time as the leg 14 is lowered. Alternatively, the soil testing device 20 may be held close to or on the deck 11 until the spud can 30 has achieved full bearing contact before the soil testing device 20 is lowered into operational position on the spud can 30, locking with the reaction base 40.

With the spud can 30 pinned to the seabed providing a stable base, communication between the soil testing device 20 and the main control unit 70 is established and the soil testing device 20 and associated monitoring sensors may be activated 203. Where the soil testing device 20 is a penetrometer 20, the penetrometer head 22 is preferably positioned at a level with the bottom surface 38 of the spud can 30 so as to enable an initial penetrometer head 22 resistance to be measured. The drive unit 21 is then operated to pass the active portion 22 through the opening 32 in the spud can 30, 204 to obtain soil data from the seabed directly beneath the spud can 30, 205.

Other than a penetrometer, the soil testing device 20 may be a soil sampler wherein the active portion 22 is a sampler tube. Alternatively, the soil testing device 20 may be a flat plat dilatometer wherein the active portion 22 is a blade, a vane shear tester wherein the active portion 22 is a vane, or any other appropriate type of soil testing device 20 having an active portion 22 for obtaining a particular type of soil data according to rig installation requirements.

Soil data obtained by the active portion 22 is preferably collected at a subsea junction box 71 for transmission to a data logger located at a main control unit 70. The subsea junction box 71 is preferably mounted to the drive unit 21. Each leg 14 of the jack-up rig is preferably provided with a soil testing device 20. The main control unit 70 is preferably located on the deck 11 in a control room where preferably all the soil testing devices 20 are activated and data signals from all the soil testing devices 20 are received and consolidated for interpretation and analyses.

Figure 4A:
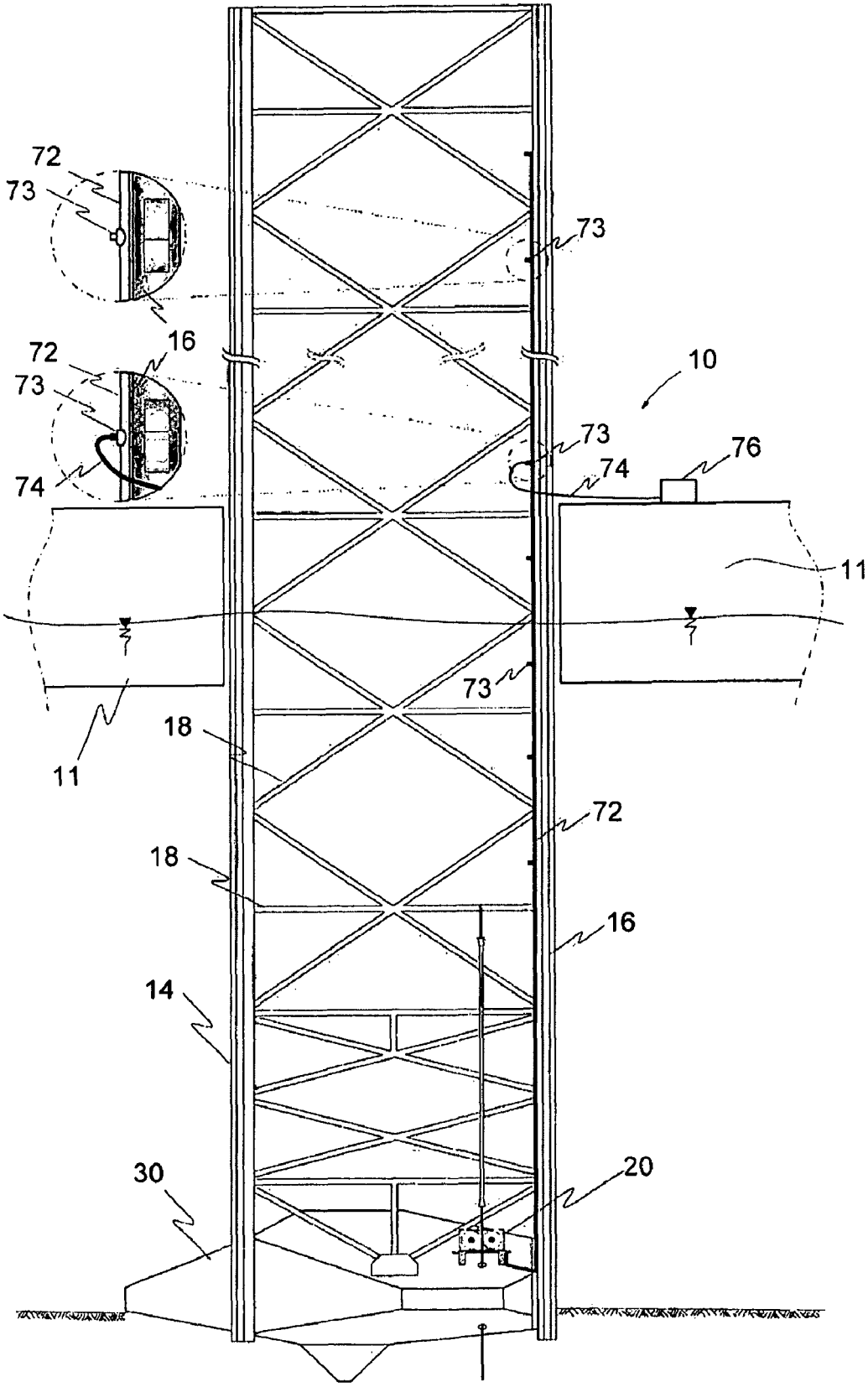
FIG. 4A is a schematic view of an exemplary embodiment of data transmission for the apparatus of FIG. 1.

Signal transmission between each soil testing device 20 and the main control unit 70 may be performed via an umbilical cable 72 connection, enabling real-time data monitoring. Preferably, the umbilical cable 72 runs along a chord 16 of the leg 14 as shown in FIG. 4A or another dedicated line fitted on the leg 14. A bottom end of the umbilical cable 72 is connected to the soil testing device 20 on the spud can 30 with a docking mechanism for electrical connection to be made under water. A top end of the umbilical cable 72 preferably terminates at the top of the leg 14. This avoids potential shearing breakage of the umbilical cable 72 between the deck 11 and a cross brace 18 of the leg 14 when the leg 14 is raised or lowered with respect to the deck 11. Preferably, a series of connection plugs 73 are provided at intervals along the umbilical cable 72 on the chord 16. The connection plugs 73 provide convenient access to the umbilical cable 72 by allowing connection of a communication cable 74 on the deck 11 to a nearest one of the connection plugs 73, regardless of displacement of the leg 14 with respect to the deck 11. The connection plugs 73 are preferably that of an underwater connector type suitable for offshore applications.

Alternatively, the umbilical cable 72 may be laid freely inside the leg 14 from the deck 11 down to the soil testing device 20.

Figure 4B:
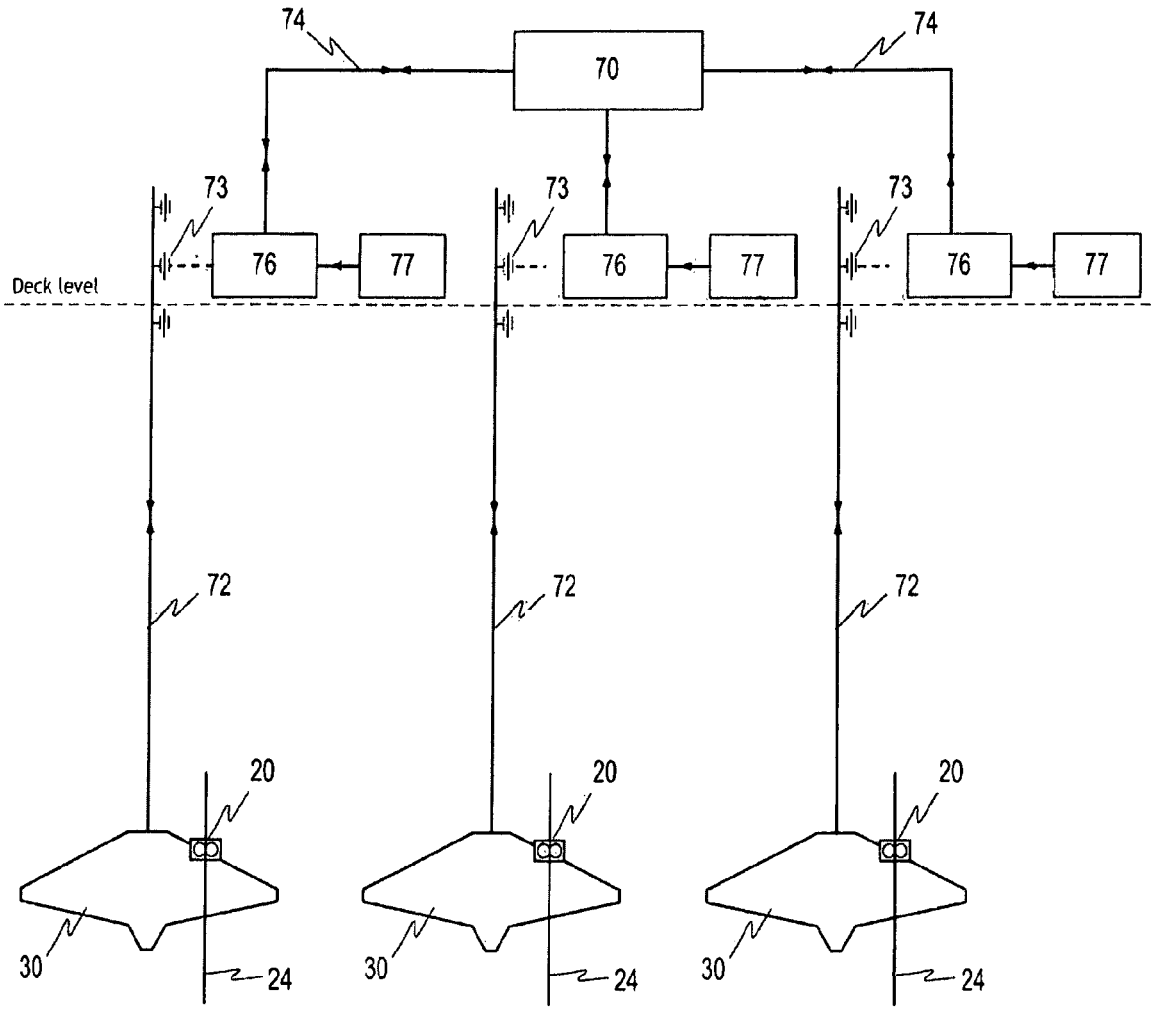
FIG. 4B is a schematic diagram of control and data transmission using the exemplary embodiment of FIG. 4A.

As shown in FIG. 4B, a permanent electrical cabinet 76 connected to an electrical source 77 available on the deck 11 may be provided for each leg 14 to power the soil testing device 20 and any other associated instruments, as well as to boost data signal when necessary. Preferably, data signals are digitized and modulated at the subsea junction box 71 before transmission via the umbilical cable connection 72 and communications cables 74 to the main control unit 70. Data obtained by the active portion 22 may be transmitted via a cable running through the push rod 24, or the push rod 24 may have a conductive core serving as a channel for data transmission to the subsea junction box 71. In another embodiment, where possible, the active portion 22 may be provided with an optical transducer for data transmission.

In an alternative embodiment, wireless signal transmission may be performed between the soil testing device 20 and the main control unit 70 via a subsea junction box 71 having a modem. The modem is preferably an acoustic modem for acoustic data transmission with another acoustic modem submerged just below the water surface and connected to the main control unit 70. Where acoustic modems are not suitable due to environmental conditions, bypass cables may be provided for communication with the main control unit 70.

Figure 5:
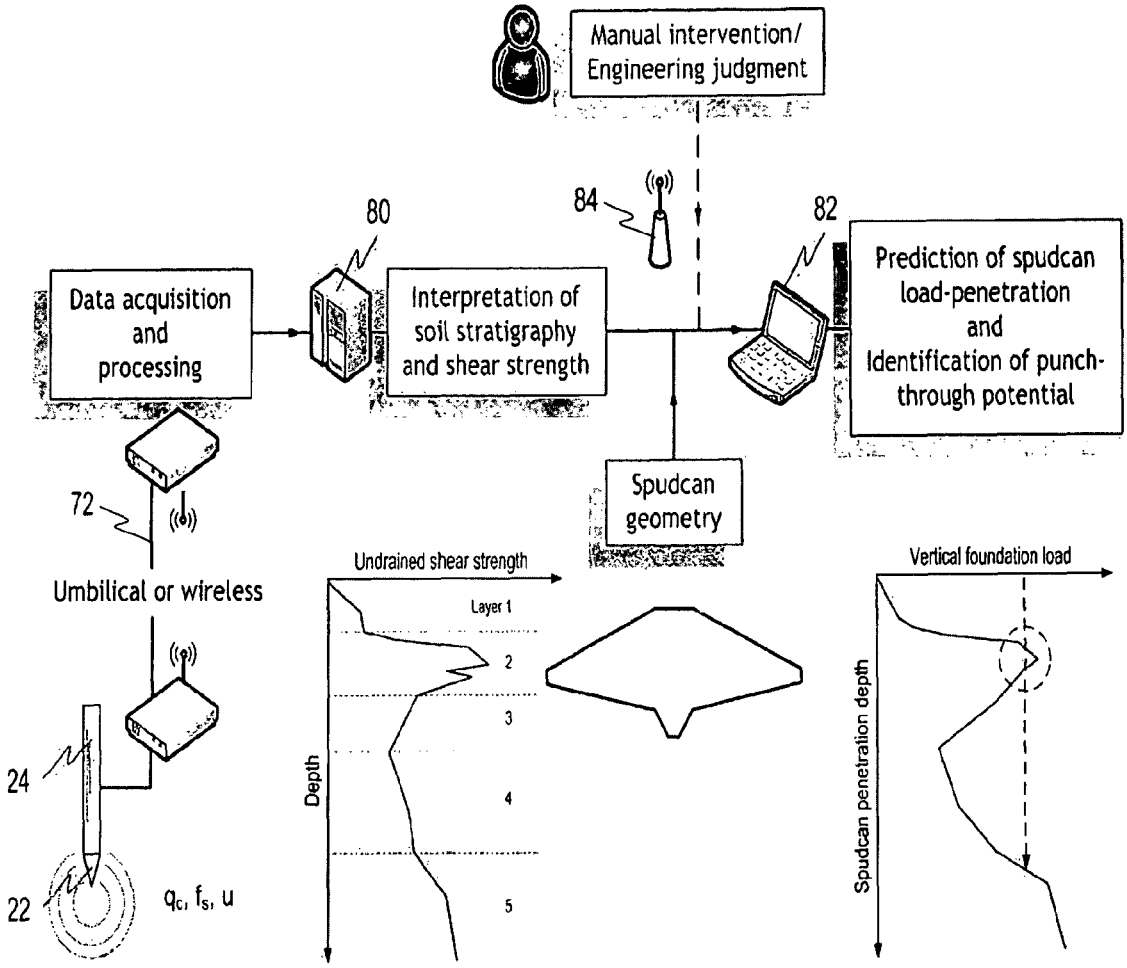
FIG. 5 is a schematic diagram of data flow and processing.

As shown in FIG. 5, using dedicated data processing and interpretation applications installed in a central processing unit 80, data obtained from the soil testing device 20 may be processed and/or interpreted to obtain useful soil information. For example, stratigraphy and shear strength of the seabed immediately below the leg 14 may be derived from data obtained through the active portion 22. The interpreted data may be further processed together with geometry of the spud can 30 and other relevant information using a proprietary application 82, 208 in order to predict and/or correlate spud can penetration behaviour with the interpreted data and to determine the likelihood of a punch-through or rapid leg penetration occurring.

Analyses and/or prediction of spud can penetration may be carried out using a conventional prediction method in which bearing capacity formulae for shallow foundations, interpreted shear strength data and spud can 30 geometry may be used as input parameters to derive a load-penetration relationship for the spud can 30 on the tested soil. Alternatively, for certain soil and layering conditions of the seabed and where the soil testing device 20 comprises a penetrometer 20 having a ball-shaped penetrometer head 22, the proprietary application 82 may be configured to perform a correlation analysis to directly correlate penetration behaviour of the penetrometer 20 with predicted penetration behaviour of the spud can 30. This is based on an underlying assumption that the penetrometer 20 is able to create a full flow-around of the soil as it penetrates the seabed, such that the penetrometer 20 can be considered to reasonably give a direct reading of the bearing capacity of another similar penetrating object like the spud can 30. In this approach, the correlation analysis preferably inherently includes various correction factors such as penetration rate effects of the penetrometer 20 or scaling factors relating to geometry of the penetrometer head 22 and the spud can 30.

The proprietary application 82 is preferably designed to allow manual intervention in the interpretation and correlation process in situations where engineering judgment may be required. Manual intervention may be facilitated by providing a wireless communication device 84 to allow an off-site expert to give input.

After soil testing has been conducted, it is desirable to unlock the drive unit 21 from the reaction base 40, 206 and retrieve the soil testing device 20, 207 before allowing further penetration of the leg 14 into the seabed during subsequent preloading. This is preferably performed without having to jack up the leg 14. Retrieving the soil testing device 20 allows maintenance and trouble shooting of the soil testing device 20 to be performed whenever required, and also prolongs the life of the soil testing device 20 by avoiding corrosion and other damage that is likely to occur if the soil testing device is left submerged and/or embedded in the seabed together with the spud can 30 for a long period.

A retrieval assembly 60 is provided for retrieving the soil testing device 20. The retrieval assembly 60 preferably comprises a first portion 62 attached to the soil testing device 20 for lifting the soil testing device 20, and a second portion 64 attached to the leg 14 for guiding the movement of the first portion 62. Preferably, the first portion 62 and the second portion 64 are configured to slideably engage each other to prevent entanglement of the soil testing device 20 with the cross braces 18 of the leg 14 during retrieval of the soil testing device 20. The first portion 62 is preferably connected via a lifting cable 92 to a lifting device such as a winch or a hoist 90. The lifting cable 92 is preferably connected to a roller 94 engaging a secondary cable 96, with both ends of the secondary cable 96 being connected to the first portion 62. The roller 94 ensures even distribution of load to the secondary cable 96.

Figure 2:
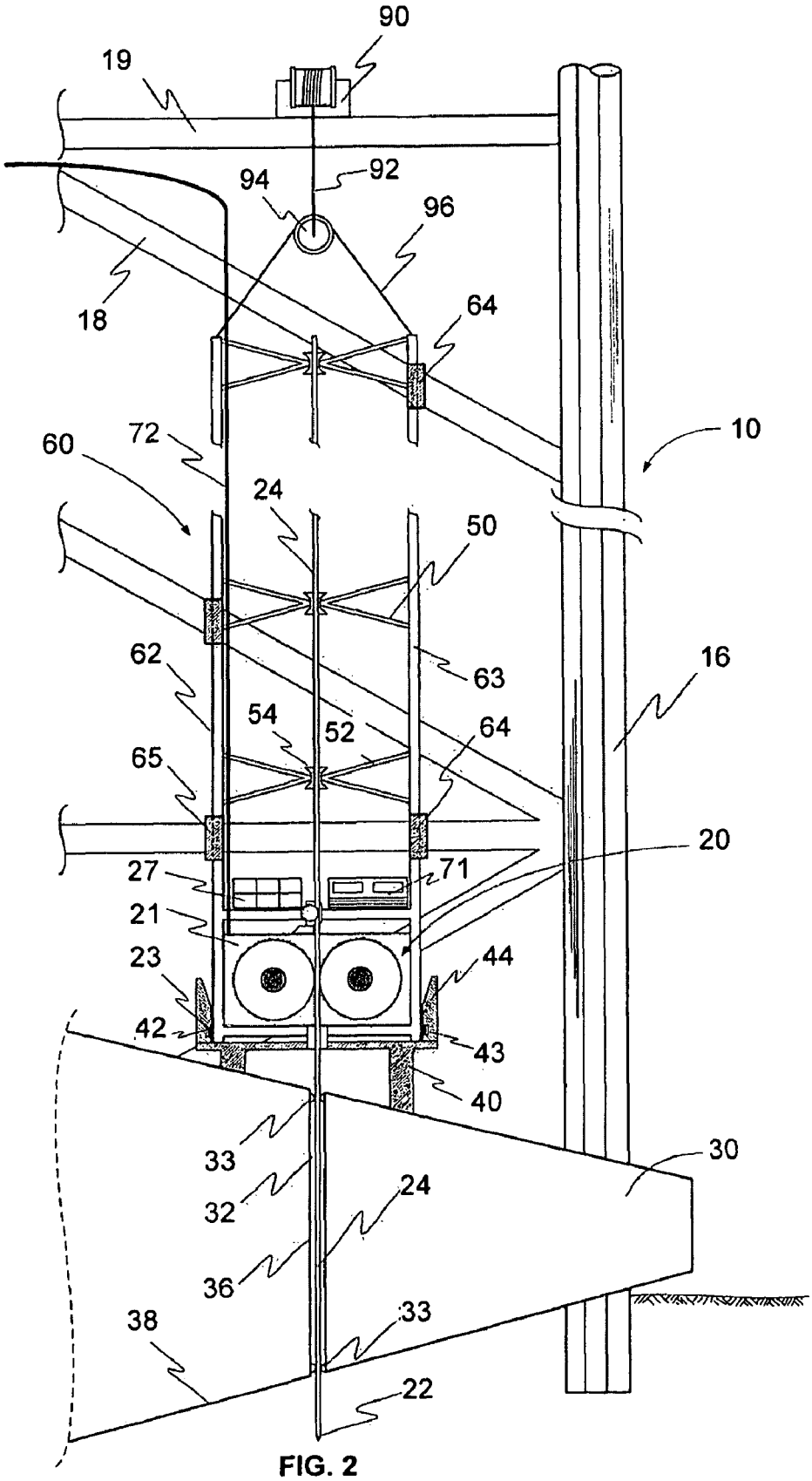
FIG. 2 is a close-up schematic view of the apparatus of FIG. 1.
Figure 3:
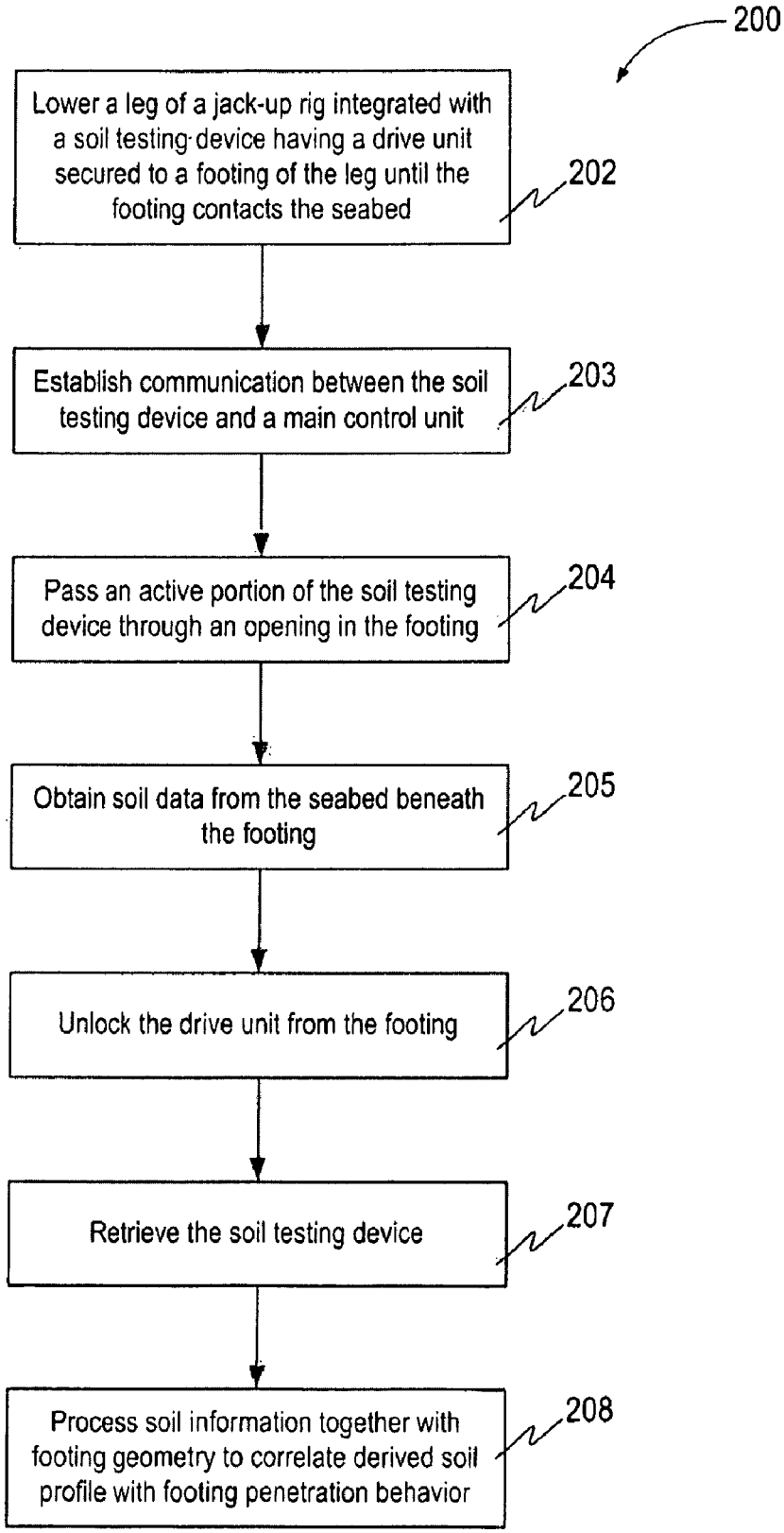
FIG. 3 is flowchart of a method for soil testing for a jack-up rig.

As shown in FIGS. 1 and 2, the first portion 62 of the retrieval assembly 60 comprises a frame having vertical posts 63 to which lateral ends of the cross frames 52 of the rod supports 50 are attached at equal intervals. The drive unit 21 is also attached to the frame 63. The second portion 64 of the retrieval assembly 60 comprises guides 65 attached to the cross braces 18 of the leg 14. The vertical posts 63 slideably engage the guides 65 which may be open sleeves having a C-shaped or H-shaped profile. Both ends of the secondary cable 96 are connected to the top of the vertical posts 63.

Figure 6:
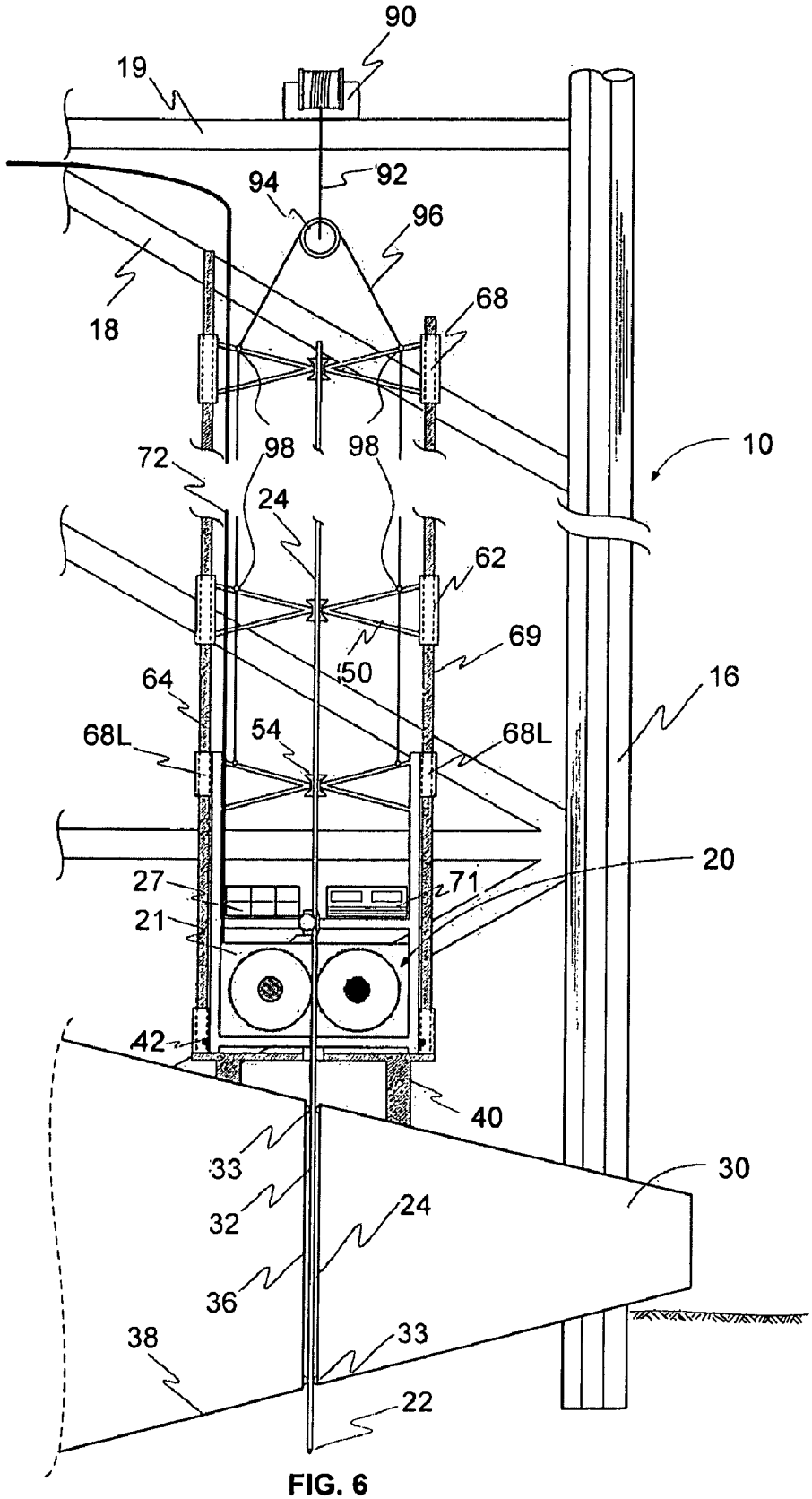
FIG. 6 is an alternative exemplary embodiment of an apparatus for soil testing for a jack-up rig.

In an alternative embodiment as shown in FIG. 6, the first portion 62 of the retrieval assembly 60 comprises guides 68 attached to the lateral ends of the cross frames 52 of the rod supports 50. The drive unit 21 is attached to a lowest pair 68L of the guides 68. The second portion 64 of the retrieval assembly 60 comprises a frame of vertical posts 69 attached to the cross braces 18 of the leg 14 and/or to the reaction base 40. The guides 68 slideably engage the vertical posts 69. Each of the plurality of rod supports 50 is preferably connected to the secondary cable 96 at connection points 98 equally spaced to either side of the centrally disposed funnel 54. To reduce weight of the retrieval assembly 60, the vertical posts 69 may be replaced by tension wires (not shown). One end of the tension wires may be secured to the reaction base 40 while another end of the tension wires may be tensioned by winches (not shown) installed on a horizontal brace 19 at an upper portion of the leg 14.

Figure 7:
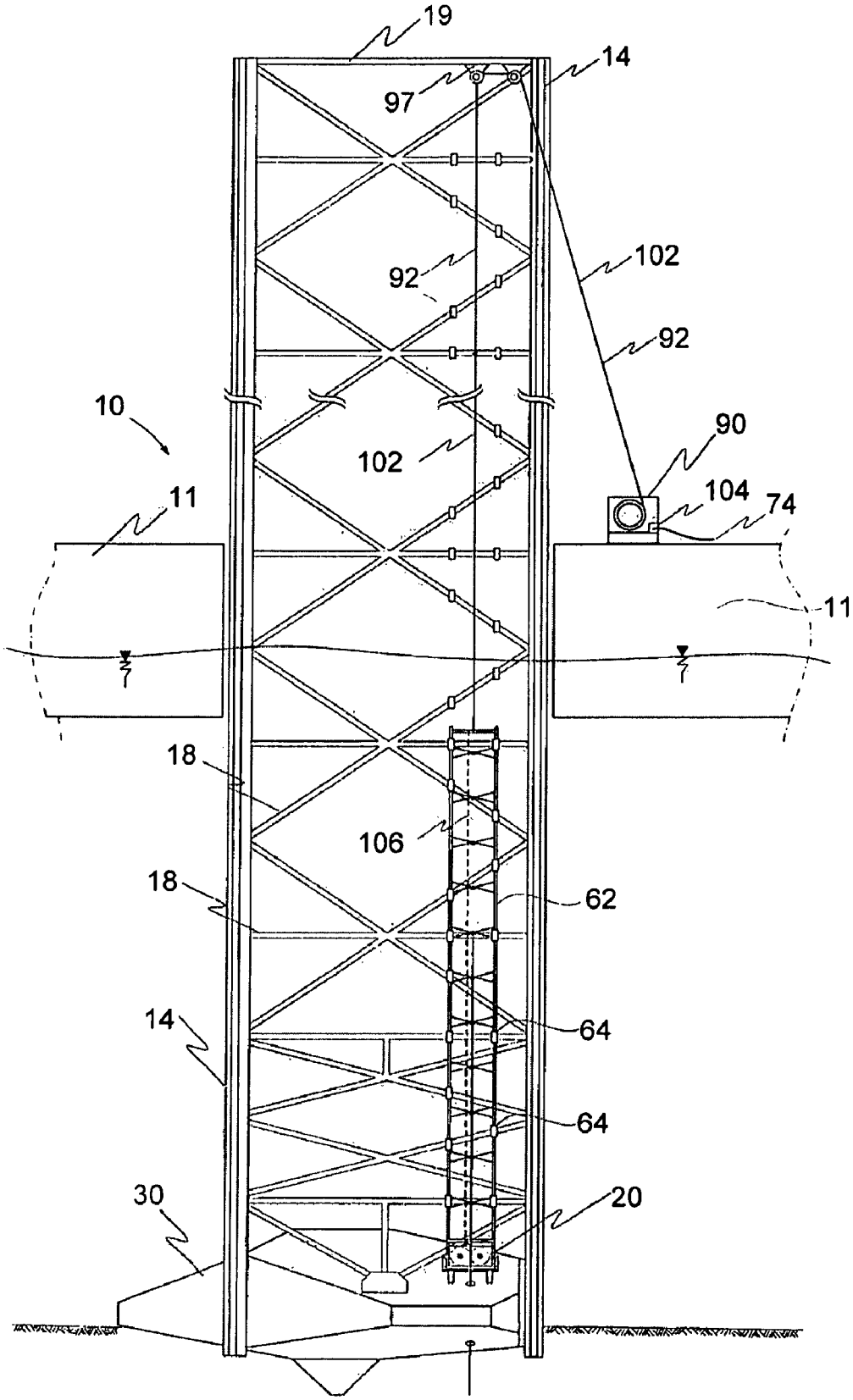
FIG. 7 is a further alternative exemplary embodiment of an apparatus for soil testing for a jack-up rig.

In the exemplary embodiments of the retrieval assembly 60, the hoist 90 should be located such that the soil testing device 20 may be lifted and temporarily locked at around the level of the deck 11 after final leg penetration is achieved. The hoist 90 may be secured to the horizontal brace 19 at the upper portion of the leg 14. Alternatively, as shown in FIG. 7, the hoist 90 may be secured to the deck 11 and the lifting cable 92 is preferably passed through a pulley configuration 97 mounted at the horizontal brace 19 at the upper portion of the leg 14 prior to connection with the first portion 62. To simplify handling of the apparatus 10, a dual-function cable 102 combining hoisting and electrical cables may replace the umbilical cable 72 and the lifting cable 92 such that only one cable 102 is used for data transmission as well as lifting the soil testing device 20 during retrieval. Where a dual-function cable 102 is used, a junction box 104 is preferably provided at the hoist 90 on the deck 11 for connection with a communication cable 74 to transmit data to the main control unit 70 via the electrical cabinet 76. A secondary electrical cable 106 may be provided to connect the dual-function cable 102 with the soil testing device 20.

Whilst there has been described in the foregoing description exemplary embodiments of the present invention, it will be understood by those skilled in the technology concerned that many variations in details of design, construction and/or operation may be made without departing from the present invention. For example, the soil testing device 20 integrated with one of the legs 14 may be of a same or of a different type as the soil testing device 20 integrated with another one of the legs 14. For each soil testing device 20, there may or may not be provided a retrieval assembly 60.

The invention claimed is:

1. An apparatus for soil testing for a jack-up rig, the apparatus comprising:

a soil testing device integrated with a leg of the jack-up rig, the leg of the jack-up rig having a footing, the soil testing device being configured to be in operational position on the footing, the soil testing device comprising a drive unit configured to drive a push rod connected to an active portion;

an opening in the footing for allowing passage of the active portion of the soil testing device therethrough to obtain soil data from a seabed beneath the footing; and a retrieval assembly for retrieving the soil testing device to a level of a deck of the jack-up rig.

2. The apparatus of claim 1, wherein the retrieval assembly comprises a first portion for attaching to the soil testing device and a second portion for attaching to the leg of the jack-up rig, the first portion being slideably engagable with the second portion to prevent entanglement of the soil testing device with the leg, the first portion being connected to a lifting device.

3. The apparatus of claim 2, wherein the first portion of the retrieval assembly is attached to a rod support of the soil testing device, the rod support being for supporting and aligning a push rod of the soil testing device, the push rod being drivable to push the active portion into the seabed beneath the footing.

4. The apparatus of claim 3, wherein the rod support comprises a plurality of cross frames, each cross frame having a central funnel for passage of the push rod therethrough.

5. The apparatus of claim 2, wherein the first portion is a frame and the second portion is a guide.

6. The apparatus of claim 5, wherein the guide comprises a plurality of open sleeves.

7. The apparatus of claim 2, wherein the first portion is a guide and the second portion comprises tension wires.

8. The apparatus of claim 2, wherein the lifting device is located on the deck.

9. The apparatus of claim 1, wherein soil data obtained by the soil testing device is transmitted to a main control unit located on a deck of the jack-up rig by a transmission means selected from the group consisting of: cabled and wireless.

10. The apparatus of claim 9, wherein the cabled transmission means comprises an umbilical cable running along the leg, the umbilical cable having a plurality of connection plugs at intervals along its length for accessing the umbilical cable from the deck via a connection with a nearest one of the plurality of connection plugs.

11. The apparatus of claim 9, wherein the cabled transmission means comprises a dual-function cable configured for electrical connection and lifting the soil testing device.

12. The apparatus of claim 1, wherein the opening comprises a through hole.

13. The apparatus of claim 12, wherein the through hole comprises a guide tube therein for passage of the active portion of the soil testing device.

14. The apparatus of claim 13, wherein the guide tube comprises dirt removing studs for cleaning the soil testing device when the soil testing device is being retracted.

15. The apparatus of claim 1, wherein the opening comprises a through slot.

16. A method of soil testing for a jack-up rig, the method comprising:

lowering a leg of the jack-up rig until a footing on the leg contacts a seabed;

setting up a soil testing device in operational position on the footing, the soil testing device comprising a drive unit configured to drive a push rod connected to an active portion, wherein the active portion includes a penetrometer head;

passing the active portion through an opening in the footing to penetrate the seabed;

obtaining soil data of the seabed beneath the footing;

retrieving the soil testing device to a level of a deck of the jack-up rig; and directly correlating penetration behaviour of the active portion with predicted penetration behaviour of the footing.

17. The method of claim 16, further comprising lowering the soil testing device together with lowering the leg.

18. The method of claim 16, further comprising positioning the active portion at a level with a bottom surface of the footing prior to penetrating the seabed beneath the footing for enabling an initial contact stress to be measured.

* * * * *

UNITED STATES PATENT AND TRADEMARK OFFICE

CERTIFICATE OF CORRECTION

PATENT NO. : 8,146,418 B2
APPLICATION NO. : 12/202884
DATED : April 3, 2012
INVENTOR(S) : Kok Seng Foo et al.

It is certified that error appears in the above-identified patent and that said Letters Patent is hereby corrected as shown below:

Please correct the spelling of the name of the first Assignee from

"Keppel Offshore & Marie Technology Centre Pte Ltd"

to

--Keppel Offshore & Marine Technology Centre Pte Ltd--

Signed and Sealed this
Fifteenth Day of May, 2012

David J. Kappos

David J. Kappos
*Director of the United States Patent and Trademark Office*